US011040553B2

(12) United States Patent
Dedic et al.

(10) Patent No.: US 11,040,553 B2
(45) Date of Patent: Jun. 22, 2021

(54) METHOD AND DEVICE FOR DRYING A PRINTED RECORDING MEDIUM

(71) Applicant: Océ Holding B.V., Venlo (NL)

(72) Inventors: Revdin Dedic, Markt Schwaben (DE); Christoph Soldner, Munich (DE); Oliver Stendel, Poing (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/570,008

(22) Filed: Sep. 13, 2019

(65) Prior Publication Data

US 2020/0086662 A1 Mar. 19, 2020

(30) Foreign Application Priority Data

Sep. 14, 2018 (DE) ..... 10 2018 122 488.5

(51) Int. Cl.
*B41J 11/00* (2006.01)
*G03G 15/20* (2006.01)
*G03G 15/16* (2006.01)

(52) U.S. Cl.
CPC ..... *B41J 11/002* (2013.01); *G03G 15/1695* (2013.01); *G03G 15/2014* (2013.01)

(58) Field of Classification Search
CPC ..... B41J 11/002; G03G 15/1695; G03G 15/2014
See application file for complete search history.

(56) References Cited

U.S. PATENT DOCUMENTS 5,333,395 A 8/1994 Bulcsu
6,481,118 B1 * 11/2002 De Vroome ..... F26B 13/10 101/424.1

FOREIGN PATENT DOCUMENTS

DE 4226107 A1 2/1994
DE 19918669 A1 10/2000

OTHER PUBLICATIONS

German Office Action dated Jul. 4, 2019, for Application No. 10 2018 122 488.5.

* cited by examiner

*Primary Examiner* — Thinh H Nguyen
(74) *Attorney, Agent, or Firm* — Schiff Hardin LLP

(57) ABSTRACT

In a method and device for drying a printed recording medium, a printed recording medium is introduced into a heated first chamber in which a temperature suitable for drying the recording medium and a first pressure are set. The printed recording medium is also introduced into a second chamber in which a second temperature that is suitable for cooling the recording medium for a further processing and a second pressure are set. The first pressure can be provided to be lower than the second pressure.

20 Claims, 3 Drawing Sheets

METHOD AND DEVICE FOR DRYING A PRINTED RECORDING MEDIUM

CROSS REFERENCE TO RELATED APPLICATIONS

This patent application claims priority to German Patent Application No. 102018122488.5, filed Sep. 14, 2018, which is incorporated herein by reference in its entirety.

BACKGROUND

Field

The disclosure relates to a method for drying a printed recording medium, as well as a device for drying a printed recording medium.

Related Art

Given printing systems with overprint applied in a liquid state, for example inkjet printing systems, following being printed to a recording medium is dried. In particular given high-capacity printing with a continuous recording medium, for example a paper web, special drying processes are performed for this.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 3:
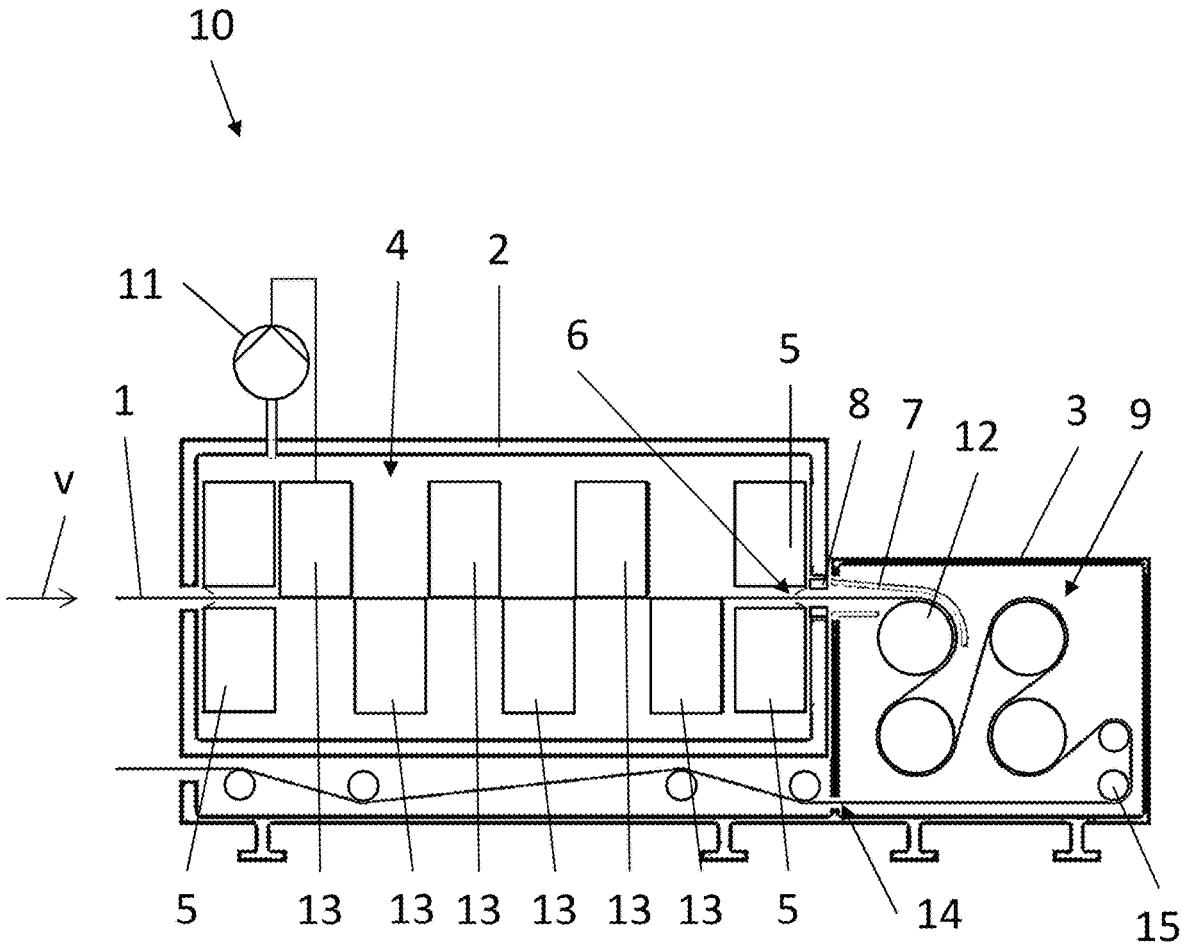

FIG. 3 illustration a drying device for drying a printed recording medium according an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

Figure 1:
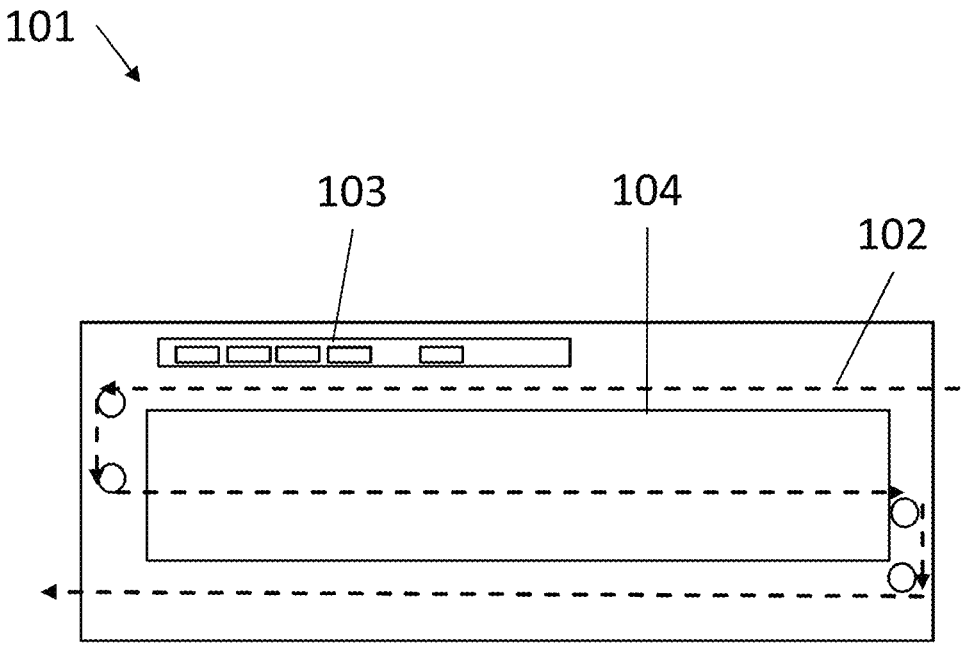
FIG. 1 is a schematic illustration of an inkjet printing system.

FIG. 1 shows an example of an inkjet printing system 101. The recording medium 102, for example, a paper web, is thereby typically first printed to at a printing station 103 and subsequently introduced into a dryer 104. In the dryer 104, the recording medium 102 is heated to a target temperature at which volatile components of the print separation are vaporized and a film formation of the overprint takes place. In operation, volatile organic compounds of the print separation are vaporized without the recording medium 102 entirely drying out and becoming brittle. The target temperature is therefore held over a predetermined duration or a predetermined distance. In the dryer 104, the recording medium is subsequently cooled to a temperature suitable for further processing, for example an additional printing or a post-processing. Upon cooling there is a requirement of avoiding an accumulation, at cold surfaces, of condensate of the components that were previously evaporated off. Therefore, in a dryer 104 comparably long drying routes have previously been used in order to achieve a sufficient degree of drying on the one hand, and on the other hand to provide for a gentle cooling to avoid a condensation of the components that were evaporated off.

An object of the present disclosure is to provide an improved method and a correspondingly improved device for drying a recording medium that has been printed to.

Aspects of the present disclosure relate to a method for drying a printed recording medium, with the steps: introduce the printed recording medium into a heated first chamber in which a temperature suitable for drying the recording medium and a first pressure are set; and introduce the printed recording medium into a second chamber in which a temperature that is suitable for cooling the recording medium for a further processing and a second pressure are set, where the first pressure is provided to be lower than the second pressure.

Primarily, the applied ink should thereby be dried (to the touch) upon the drying of the recording medium.

The disclosure also relates to a device for drying a printed recording medium, including using a method that includes: a first chamber that is configured to be heated to dry the recording medium with a first temperature; a second chamber that is configured to cool the recording medium to a second temperature suitable for further processing; and a pressure adjustment controller configured to set a pressure difference between the first chamber and the second chamber, wherein a first pressure in the first chamber can be set to be lower than a second pressure in the second chamber.

Aspects of the disclosure include a drying route for the drying process and the cooling that are advantageously shorter while avoiding condensate accumulations.

In an exemplary embodiment, the drying route is divided up into two chambers that are essentially fluidically separated from one another, where the drying of the recording medium is performed in a first chamber and the cooling of the recording medium is performed in a second chamber. Advantageously, condensate accumulations can be limited to a region of a transition of the recording medium from the first chamber into the second chamber, in particular at a gap that is provided for the transition. Via a pressure difference that is present at the transition, with a lower pressure in the first chamber in comparison to the second chamber, an air transfer between the chambers occurs exclusively from the second chamber into the first chamber. Components that are evaporated off in the drying of the recording medium in the first chamber thus remain entirely in the first chamber, in which the heated air but a comparably high dissolving power are provided such that no condensation occurs. In the cooler second chamber, due to the zone separation, the concentration of volatile components is kept so low that no condensation likewise occurs.

According to the disclosure, condensate formation is concentrated at the region of the transition from the first chamber into the second chamber. In exemplary embodiments of the present disclosure, the condensate formation is counteracted by a continuous air current from the second chamber into the first chamber, where the air current results from the pressure difference. The air in the second chamber, which is drier and also cooler, is heated in the passage into the first chamber and thus may, to a large extent, absorb condensate occurring at the transition. In one or more exemplary embodiments, additional measures for diverting and/or vaporizing the condensate may be taken in the region of the transition in a way that is essentially decoupled from the two chambers, separate from the actual drying and the actual cooling.

In an exemplary embodiment, the recording medium is provided as a continuous web which is directed continuously from the first chamber into the second chamber. For example, it may be a paper web. The present disclosure is not limited to continuous webs and is application to recording mediums in other forms as would be understood by one of ordinary skill in the art.

The present disclosure is used in high-capacity printing methods with feed velocity of the recording medium of greater than 20 meters per minute. At such high printing velocities, a comparably high vapor pressure is created in a dryer upon drying. According to the disclosure, this vapor pressure is limited to the first chamber and thus, advantageously, has little to no effect on the cooling performed in the second chamber.

Overall, according to the disclosure a drying route is in this way shortened to a length that is only necessary for the actual drying and cooling. In particular, no temperature cascading of the drying route is thus necessary to avoid condensate. A stepped reduction of the temperature over the drying route may therefore be omitted. In this way, a drying device for drying the recording medium according to exemplary embodiments, and therefore the entire printing system, may be built significantly more compactly. In particular, a reduced device length advantageously results.

According to the disclosure, the energy consumption for drying may also be starkly reduced. In particular, markedly less fresh air is required for drying of the recording medium, since less consideration needs to be given to a concentration of vaporized components in the circulating air of the first chamber. Rather, the air used for drying may be at least partially drawn from the already heated first chamber, and thus heating energy may be saved. A proportion of circulating air is thus increased. A possible cooling air in the second chamber also does not need to initially be heated, since according to the disclosure, the concentration of volatile components in the second chamber is kept low. No heating power is thus required for the temperature adaptation. Overall, the building costs and the space requirements are thus advantageously reduced due to the shorter device length, and in particular the operating costs of a printing system are also reduced due to the lower power consumption.

Figure 2:
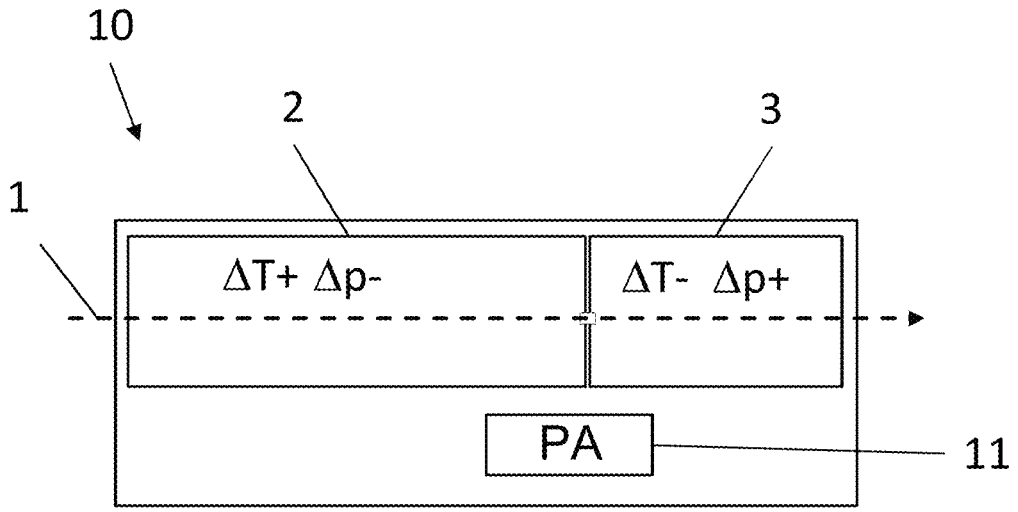
FIG. 2 is a schematic illustration of a drying device for drying a printed recording medium according an exemplary embodiment of the present disclosure.

FIG. 2 shows a schematic illustration of a drying device 10 configured to dry a printed recording medium 1 according to an exemplary embodiment.

In an exemplary embodiment, the device 10 is provided in a printing system 101 (see FIG. 1), such as in dryer 104.

In an exemplary embodiment, the device 10 has a first chamber 2 that is configured to be heated to dry the recording medium 1 with a first temperature ΔT+. A second chamber 3 is also provided that is configured to cool the recording medium 1 to a temperature ΔT− that is suitable for a further processing. In an exemplary embodiment, the device 10 also has a pressure adjustment controller 11 configured to set a pressure difference between the first chamber 2 and the second chamber 3. In an exemplary embodiment, a first pressure Δp− in the first chamber 2 is set lower than a second pressure Δp+ in the second chamber. In an exemplary embodiment, the pressure adjustment controller 11 includes processor circuitry that is configured to perform one or more operations and/or functions of the pressure adjustment controller 11, including setting a pressure difference between the first chamber 2 and the second chamber 3.

A method for drying a printed recording medium 1 can be implemented with such a device 10. In an exemplary embodiment, the method includes a step of introducing the printed recording medium 1 into the heated first chamber 2, in which the temperature ΔT+ that is suitable for drying the recording medium and the first pressure Δp− are set. The method also includes the introduction of the printed recording medium 1 into the second chamber 3, in which the temperature ΔT− that is suitable for cooling the recording medium for a further processing and the second pressure Δp+ are set. In this example, the first pressure Δp− is provided to be lower than the second pressure Δp+, but is not limited thereto.

In an exemplary embodiment, the recording medium is provided as a continuous web which is directed continuously from the first chamber 2 into the second chamber 3. The method for drying the printed recording medium 1 can be used in high-capacity printing systems with feed velocities of the recording medium 1 of greater than 20 meters per minute, for example.

The device 10 according to the disclosure and the method according to the disclosure are suitable for printing methods with overprint applied in a liquid state. For example, this may be an inkjet printing method. However, other printing methods with overprint applied in a liquid state are also conceivable, for example digital liquid toner printing methods, in particular electrophotography, or the like.

In an exemplary embodiment, the first temperature ΔT+ is provided for vaporizing liquid organic compounds of a liquid applied overprint. A drying of the overprint, and therefore of the recording medium 1, occurs in this way. In an exemplary embodiment, the first temperature ΔT+ is in particular selected such that, in addition to the vaporization of volatile components, a desired film formation of the overprint occurs, for example via cross-linking reactions of the overprint and/or absorption of volatile components into the substrate of the recording medium 1. In an exemplary embodiment, the temperatures for recording medium printed to in an inkjet printing method are in a range from 120-150° C., but are not limited thereto.

In an exemplary embodiment, the recording medium 1 is dried by hot air in the first chamber 2. For this, the first chamber has a hot air dryer 4. Nevertheless, a lower pressure Δp−, preferably a negative pressure, is applied in the first chamber, so that a vapor pressure of the volatile components that are vaporized by the hot air dryer 4 is displaced entirely into the first chamber 2. However, since a markedly higher dissolving power is present in the hot air, no condensation occurs. Due to the negative pressure, the volatile components also remain within the first chamber 2 or are exhausted in the form of exhaust air. In this way, a charging of an environment with the volatile components is also reliably avoided. In an exemplary embodiment, the hot air dryer 4 is a hot air float dryer that is configured to float-dry the recording medium 1 without contact. The recording medium 1 is thus heated to the first temperature ΔT+ via forced convection by an impinging current. In particular, the recording medium 1 is also held at this temperature over the remaining length of the first chamber 2. In an exemplary embodiment, the length of the first chamber 2 is accordingly chosen so that a final robust state of the printed recording medium 1, meaning a drying state that is sufficient for any further processing, is achieved at its exit. In particular, however, the length of the first chamber 2 is short enough in order to not completely dry out the recording medium 1, in particular with regard to its water content. In this way, the recording medium retains its flexibility and is not embrittled by the drying.

In an exemplary embodiment, the first pressure Δp− is set as a negative pressure. The pressure adjustment controller 11 is in this instance coupled at least with the second chamber 3. In the second chamber 3, the second pressure Δp+ may accordingly be set as the ambient pressure or a lower negative pressure. In particular, the air used for hot air drying is drawn at least partially from the first chamber 2. A circulating air portion in the first chamber 2 is thus increased. A negative pressure is thus synergistically set, at least in part, in the first chamber 2, and at the same time heating energy is saved in comparison to a supply of fresh air, since the air located in the first chamber is already heated. Naturally, however, additional fresh air may be supplied and/or exhaust air may be discharged as needed, for example in order to regulate a concentration of volatile components in the circulating air.

In an exemplary embodiment, alternatively or additionally to a negative pressure in the first chamber 2, the second pressure Δp+ is provided as an overpressure. In this instance, the pressure adjustment controller 11 would then alternatively or additionally be coupled with the second chamber 3.

In an exemplary embodiment, a laminar boundary layer above the heated recording medium 1 is peeled off in a region of the exit of the recording medium 1 from the first chamber 2 and is held within the first chamber 2. This laminar boundary layer contains volatile organic compounds which are held in the first chamber in this way. In an exemplary embodiment, an air blade 5 is provided (see FIG. 3) in the region of the exit of the recording medium 1 from the first chamber 2 to remove the laminar boundary layer. For example, the air blade 5 may include one or more nozzles with long, narrow exit aperture. In an exemplary embodiment, the air blade 5 extends transversally across the entire exit region of the first chamber 2. A flow profile and a flow velocity of the air blade 5 are accordingly provided in order to peel off the laminar boundary layer. In an exemplary embodiment, an air curtain is used for a zone separation between the first chamber 2 and the second chamber 3.

In an exemplary embodiment, the first chamber 2 and the second chamber 3 are fluidically connected only via a gap 6 formed to feed the recording medium through (see FIG. 3). The chambers 2, 3 are otherwise separated from one another. In an exemplary embodiment, a continuous air flow through the gap 6, from the second chamber 3 into the first chamber 2, is thus provided by the pressure difference set by the lower first pressure Δp− at the gap 6. In an exemplary embodiment, the second chamber 3 is supplied with fresh air for pressure compensation. In this way, on the one hand a passage of the air enriched with volatile components from the first chamber 2 into the second chamber 3 is effectively prevented, and on the other hand a concentration of volatile components in the second chamber 3 is constantly kept low.

In an exemplary embodiment, the gap 6 is formed with a connecting tunnel 7 (see FIG. 3) through which the recording medium 1 is directed from the first chamber 2 into the second chamber 3. Upon passage of the recording medium 1 from the hotter first chamber 2 into the colder second chamber 3, the recording medium 1 continues to give off vapor, wherein in particular volatile organic components also still evaporate. Within the connecting tunnel 7, such vapors are drawn off into the first chamber 2 by the present pressure difference. The volatile components thus advantageously do not arrive in the second chamber 3, so that there a condensation of such vapors cannot take place.

In an exemplary embodiment, the recording medium 1 is cooled by contact upon entrance into the second chamber 3. In particular, the contact cooling is provided directly following the connecting tunnel 7. In this way, the temperature of the recording medium 1 is very rapidly decreased, so that an additional subsequent evaporation is minimized. In particular, cooling rollers 12 may be provided for this (see FIG. 3) which are arranged directly at the output of the connecting tunnel 7. The contact cooling has the advantage that no active vaporization occurs, which is different than given cold air cooling with impinging flow. In particular, a first cooling roller 12 may even protrude at least partially into the connecting tunnel 17, so that the contact cooling begins directly at the output or even within the connecting tunnel 7.

In an exemplary embodiment, the connecting tunnel 7 is heated at least in segments. In this way, a condensate formation within the connecting tunnel 7 is avoided. Alternatively or additionally, a separating wall 8 separating the first chamber 2 and the second chamber 3 may be heated at least in segments. A condensate formation is advantageously effectively avoided in this way in the region of the passage of the recording medium 1 from the first chamber 2 into the second chamber 3.

FIG. 3 shows a drying device 10 configured to dry a printed recording medium 1 according to an exemplary embodiment.

As shown in FIG. 3, the hot air dryer 4 of the first chamber 2 is configured as a no-contact hot air float dryer having a plurality of hot air blowers 13 arranged above and below the recording medium 1. The depicted number of hot air blowers is self-evidently to be understood as purely illustrative, and can be adapted as needed, in particular to the length of the drying route required to achieve the desired final robust drying state.

In an exemplary embodiment, the pressure adjustment controller 11 is a pump configured to generate a first pressure Δp− (provided as a negative pressure) in the first chamber 2, and is coupled with the air intake of the hot air dryer 4. In an exemplary embodiment, a portion of the air discharged from the first chamber 2 for generation of the negative pressure by the pressure adjustment controller 11 is supplied to an air intake of the hot air dryer 4. In an exemplary embodiment, an additional portion of the air discharged from the first chamber 2 is discharged as exhaust air. According to the disclosure, a comparably high circulating air proportion is enabled since no consideration—or only markedly less consideration, in comparison to conventional hot air float dryers—needs to be given to the level of the concentration of volatile components within the first chamber 2, especially as a condensation within the first chamber 2 is avoided via the high temperature prevailing there.

In an exemplary embodiment, a passage from the first chamber 2 into the second chamber 3 is formed with a connecting tunnel 7 that is configured such that vapors arising given subsequent fuming of the recording medium 1 within the connecting tunnel 7 can be drawn off without condensation via the pressure difference that is present in the first chamber 2. For example, the connecting tunnel 7 may be designed to be heated. In the present embodiment, the connecting tunnel additionally extends like a beak (e.g. overhang) from a gap 6, where the gap 6 is formed from the first chamber 2 at the exit of the recording medium 1 into the second chamber 3. The second chamber 3 has a contact cooler 9 directly following the connecting tunnel 7 or its output, which contact cooler 9 is formed with a cooling roller 12 extending partially into the connecting tunnel 7.

In an exemplary embodiment, the beak shape of the connecting tunnel 7 thereby partially includes the cooling roller 12, so that a first segment of an effective cooling route within the second chamber 3 is covered by the connecting tunnel 7. Within this covered region, possible vapors emitted by subsequent fuming of the still-hot recording medium 1 are directly drawn off into the first chamber 3 via the connecting tunnel 7. In this way, the recording medium in the second chamber 3 is only released to the ambient air located therein if this has a temperature that has already declined, so that a subsequent fuming within the second chamber is avoided or minimized.

In an exemplary embodiment, an air blade 5 is provided on both sides of the recording medium 1 in a region of the gap 6 or of the exit of the recording medium 1 from the first chamber 2 into the connecting tunnel 7. In this way, the laminar boundary layer, which contains particularly many volatile components, can be peeled off above the heated recording medium 1 before the exit from the first chamber 2. In addition to this, an air blade 5 is also provided at an entrance of the first chamber 2, which air blade 5 forms an air curtain at said entrance. The volatile components of the laminar boundary layer are thus reliably kept within the first chamber 2 and do not escape into the second chamber 3 or into the environment.

Overall, it is thus achieved that only a minimal concentration of volatile components is present within the second chamber, such that no condensation occurs in spite of the cooler temperature $\Delta T-$ that prevails therein. In particular, cooling rollers 12 may therefore be actively cooled, for example with a cooling fluid. In the depicted embodiment, the contact cooler 9 has a plurality of cooling rollers arranged within the second chamber 3, across which cooling rollers the recording medium 1 is directed. Here, four cooling rollers are presented purely as illustration. Naturally, however, the number and embodiment of cooling rollers can be adapted as needed, for example to the type of recording medium or its thermal capacity and a desired temperature $\Delta T-$ for the further processing.

In an exemplary embodiment, a condensation of volatile components is also avoided in the region of the transition between the first and second chamber. For this, a separating wall 8 that separates the first chamber 2 from the second chamber 3 has a condensation-preventing design that, for example, includes a heating. In particular, it may be provided that the region of the gap 6 is heated. Alternatively or additionally, an insulation may also be provided so that a dew point in the separating wall 8 is shifted.

In an exemplary embodiment, the drying device 10 advantageously only requires the length that is necessary for the actual drying within the first chamber 2 and for the actual cooling within the second chamber. In particular, no additional device length is required for a temperature adaptation between a hot zone and cold zone, as in conventional no-contact hot air float dryers. The device 10 according to the disclosure is thus markedly more compact in design and requires markedly less energy.

In an exemplary embodiment, after the contact cooler 9 is traversed, the recording medium 1, which is transported with a feed velocity of more than 20 meters per minute, is directed out of the second chamber 3 via deflection rollers 15 to an opening 14 arranged below the gap 6, and is directed through below the first chamber 2 in order to leave the device 10 below an intake of the first chamber 2. Alternatively, in an exemplary embodiment, it would also be conceivable to guide the recording medium 1 directly out of the device 10 at an opening provided in the second chamber 3.

In an exemplary embodiment, the recording medium 1 is then processed further in a subsequent module of a printing system 101. For example, for this the recording medium may be further printed to in an additional printing tower or be post-processed in a post-processing station, for example be taken up or cut.

For example, the cooling of the recording medium 1 in the second chamber 3 may also be performed with a different type of cooler instead of a contact cooler 9. In particular, it would also be conceivable to alternatively or additionally use cold air blowers to cool the recording medium 1.

Analogously, it would also be conceivable to use a different type of dryer in the first chamber 2 instead of a hot air float dryer.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 printing system
2 first chamber
3 second chamber
4 hot air dryer
5 air blade
6 gap
7 connecting tunnel
8 separating wall
9 contact cooler
10 drying device
11 pressure adjustment controller
12 cooling roller
13 hot air blower
13 opening
ΔT− second temperature
ΔT+ first temperature
Δp− first pressure
Δp+ second pressure
v feed velocity
101 inkjet printing system
102 recording medium
103 printing station
104 dryer

The invention claimed is:

1. A method for drying a printed recording medium, comprising:

introducing the printed recording medium into a heated first chamber having a first temperature configured to dry the recording medium and a first pressure;

introducing the printed recording medium from the first chamber into a second chamber having a second temperature configured to cool the recording medium and a second pressure; and setting, using a pressure adjustment controller, the first chamber to the first pressure and the second chamber to the second pressure to set a pressure difference between the first chamber and the second chamber, wherein the first pressure is lower than the second pressure.

2. The method according to claim 1, wherein the first temperature is set such that the first temperature vaporizes volatile organic compounds of an applied liquid overprint.

3. The method according to claim 1, wherein the recording medium is dried by hot air generated in the first chamber.

4. The method according to claim 3, wherein the hot air is generated by a hot air float dryer such that the printed recording medium is float-dried without contact.

5. The method according to claim 1, wherein the first pressure is a negative pressure.

6. The method according to claim 5, wherein air for hot air drying in the first chamber is at least partially drawn from the first chamber to at least partially set the first pressure as the negative pressure in the first chamber.

7. The method according to claim 1, further comprising: removing, using an air blade, a laminar boundary layer above the heated recording medium from the recording medium in an exit region of the first chamber, the removed laminar boundary layer being held within the first chamber.

8. The method according to claim 1, wherein the first chamber and the second chamber are separated from one another and only fluidically connected with one another via a gap formed to pass the recording medium from the first chamber to the second chamber, wherein a continuous air flow through the gap from the second chamber into the first chamber is provided by a pressure difference at the gap based on the lower first pressure.

9. The method according to claim 8, wherein the gap is formed with a connecting tunnel through which the recording medium is directed from the first chamber into the second chamber.

10. The method according to claim 9, wherein the connecting tunnel is at least heated in segments to prevent condensation.

11. The method according to claim 9, wherein a separating wall separating the first chamber and the second chamber is at least heated in segments to prevent condensation.

12. The method according to claim 1, wherein the recording medium is cooled upon entrance into the second chamber by contact with cooling rollers included in the second chamber.

13. The method according to claim 1, wherein the first temperature is greater than the second temperature.

14. A non-transitory computer-readable storage medium with an executable program stored thereon, that when executed, instructs a processor to perform the method of claim 1.

15. A drying device for drying a printed recording medium, comprising:

a first chamber configured to be heated to a first temperature to dry the recording medium;

a second chamber configured to be set to a second temperature to cool the recording medium; and a pressure adjustment controller configured to set the first chamber to first pressure and the second chamber to a second pressure to set a pressure difference between the first chamber and the second chamber, wherein the first pressure in the first chamber is lower than the second pressure in the second chamber.

16. The device according to claim 15, wherein the first chamber comprises a hot air dryer coupled to the pressure adjustment controller and configured to dry the recording medium, an air intake of the hot air dryer being configured to at least partially generate the first pressure as a negative pressure.

17. The device according to claim 15, further comprising a separating wall separating the first chamber from the second chamber, the separating wall being configured to prevent condensation.

18. The device according to claim 15, further comprising a passage from the first chamber into the second chamber, the passage being formed with a heated connecting tunnel configured such that vapors generated by the heating of the recording medium within the connecting tunnel are drawn off the recording medium and into the first chamber without condensation based on the pressure difference.

19. The device according to claim 18, wherein the heated connecting tunnel comprises an air blade in an exit region of the first chamber that is configured to remove a laminar boundary layer above the heated recording medium from the recording medium, the removed laminar boundary layer being held within the first chamber.

20. The device according to claim 18, wherein the second chamber comprises a contact cooler directly following the connecting tunnel, the contact cooler including a cooling roller extending at least partially into the connecting tunnel.

* * * * *